US009766586B2

(12) United States Patent
Doi et al.

(10) Patent No.: US 9,766,586 B2
(45) Date of Patent: Sep. 19, 2017

(54) IMAGE FORMING APPARATUS

(71) Applicant: CANON KABUSHIKI KAISHA, Tokyo (JP)

(72) Inventors: Shigeo Doi, Toride (JP); Tadahisa Sugiyama, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/867,249

(22) Filed: Sep. 28, 2015

(65) Prior Publication Data

US 2016/0098007 A1 Apr. 7, 2016

(30) Foreign Application Priority Data

Oct. 2, 2014 (JP) ..... 2014-203685

(51) Int. Cl.
*G03G 21/16* (2006.01)

(52) U.S. Cl.
CPC ..... *G03G 21/1633* (2013.01)

(58) Field of Classification Search
CPC ..... G03G 21/1633; G03G 21/1687; G03G 21/1628; G03G 21/169
See application file for complete search history.

(56) References Cited

U.S. PATENT DOCUMENTS 7,155,777 B2 * 1/2007 Connors ..... H04N 1/00519 16/286
7,369,794 B2 * 5/2008 Kawai ..... B41J 29/02 399/107
7,764,905 B2 * 7/2010 Ohta ..... G03G 21/1628 399/125
7,957,675 B2 * 6/2011 Iijima ..... H04N 1/00519 347/108
9,116,500 B2 * 8/2015 Ito ..... G03G 21/1619
2003/0056324 A1 * 3/2003 Yazawa ..... E05D 11/08 16/289
2004/0032578 A1 * 2/2004 Chen ..... G03B 27/62 355/75
2006/0093397 A1 * 5/2006 Yamaoka ..... G03G 15/165 399/110
2006/0120756 A1 * 6/2006 Ahn ..... G03G 21/1633 399/124

(Continued)

FOREIGN PATENT DOCUMENTS

JP 2003-241466 A 8/2003
JP 2006-83551 A 3/2006

(Continued)

*Primary Examiner* — Justin Rephann
(74) *Attorney, Agent, or Firm* — Fitzpatrick, Cella, Harper & Scinto

(57) ABSTRACT

A door is held in an open condition by locking a stopper member whose one end is turnably supported by an apparatus body. The stopper member is composed of a base member having a project portion and a turning shaft portion supported by a printer body, and a reinforcing member. The reinforcing member is joined with the base member by a joining mechanism such that, in a case when a force of predetermined magnitude is applied to the door in opening the door, the base member is broken and the reinforcing member holds the door by supporting the project portion and the turning shaft portion of the broken base member.

20 Claims, 12 Drawing Sheets

(56) References Cited

U.S. PATENT DOCUMENTS

| | | | | |
|---|---|---|---|---|
| 2007/0147882 | A1* | 6/2007 | Igarashi | B41J 13/025 399/110 |
| 2007/0215594 | A1* | 9/2007 | Hashimoto | B41J 29/13 219/400 |
| 2008/0175620 | A1* | 7/2008 | Ohta | G03G 21/1628 399/125 |
| 2009/0022516 | A1* | 1/2009 | Ohta | G03G 21/1628 399/126 |
| 2009/0175648 | A1* | 7/2009 | Tsuchiya | G03G 21/1633 399/107 |
| 2014/0016962 | A1* | 1/2014 | Sato | G03G 21/1623 399/107 |
| 2014/0028170 | A1* | 1/2014 | Ito | G03G 21/1628 312/327 |
| 2016/0018780 | A1* | 1/2016 | Sugiyama | G03G 21/1633 399/110 |
| 2016/0039624 | A1* | 2/2016 | Abe | G03G 21/1633 399/110 |
| 2016/0091857 | A1* | 3/2016 | Hashimoto | F16H 7/0827 399/117 |
| 2016/0161909 | A1* | 6/2016 | Wada | G03G 21/1633 399/124 |

FOREIGN PATENT DOCUMENTS

| | | | |
|---|---|---|---|
| JP | 2007-279274 | A | 10/2007 |
| JP | 2009-134227 | A | 6/2009 |

* cited by examiner

IMAGE FORMING APPARATUS

BACKGROUND OF THE INVENTION

Field of the Invention

The present invention relates to an image forming apparatus including an openable door.

Description of the Related Art

Hitherto, an image forming apparatus such as a printer is provided with an openable door on a side surface of an apparatus body such that the door can be opened for the purpose of removing a jammed sheet or of maintaining the apparatus. In such an image forming apparatus, the door is generally configured such that the door moves to an open position by its own weight when a user removes his/her hands from the door when opening the door so that the door does not stop at a mid-position between a closed position and an open position.

By the way, when the door moves to the open position as the user removes his/her hands from the door, a large impact force is generated on the door and the image forming apparatus body. Then, conventionally, an oil damper is provided in an opening/closing mechanism of a cover of the image forming apparatus as an impact relieving portion for relieving such impact by reducing a moving speed of the door in an opening direction, as disclosed in Japanese Patent Application Laid-open Nos. 2006-83551 and 2007-279274. Still further, an image forming apparatus can be provided with a spring to bias the door in a closing direction to restrict the moving speed of the door in the opening direction, as disclosed in Japanese Patent Application Laid-open Nos. 2003-241466 and 2009-134227, for example.

Here, in relieving the impact generated in opening the door by using the impact relieving portion, it is necessary to set a braking force of the impact relieving portion to reduce the moving speed of the door in the opening direction while assuming a maximum value of the impact force, or operation force generated in opening the door. Here, if the impact relieving portion is used, it is necessary to assess a maximum value of the operation force applied by the user in opening the door and others, and to balance various aspects such as compatibility of the impact relieving portion and the operation force of the user, cost performance of the configuration of the impact relieving portion, and others.

However, the image forming apparatus is restricted variously due to its entire configuration in reality, and there are various problems in setting the configuration and the braking force of the impact relieving portion. If a rotary damper is used as the impact relieving portion, for example, it is necessary to configure the rotary damper such that a force of opening the door generated by the weight of the door itself exceeds a restricting force of the rotary damper within a range in which the rotary damper effectively functions within an opening/closing operational area of the door.

In this case, a force generated when the user vigorously opens the door wholly becomes an impact force. That is, it is important to assume how much force the user applies to the door in setting a rotational load of the rotary damper. If the force applied to the door is underestimated here, and if a force greater than the estimation is applied to the door, not only can damage occur to the door itself or components related to the door, but also to the body of the image forming apparatus and a frame composing the frame body in particular. In contrast, if the force applied to the door is overestimated, it may become difficult to move the door to the open position by the weight of the door itself, and hence operability thereof is reduced.

Meanwhile, in the case of a configuration using a spring as the impact relieving portion and of relieving the impact in opening the door by applying resistance in the opening direction of the door, the same problems as those which arise when the rotary damper is used are assumed to occur in setting a strength of a spring force. Still further, because the force of the spring is applied in a direction of closing the door when the spring is used, and the spring bias force is added to the operation force of the user in closing the door, speed of the door is accelerated as the door approaches the closed position. Therefore, it is also necessary to consider the relief of the impact in closing the door.

SUMMARY OF THE INVENTION

According to one aspect of the invention, an image forming apparatus includes an apparatus body, a door openably supported by the apparatus body, an arm portion whose one end is supported by the apparatus body and locking and holding the door in an open condition. The arm portion includes a body portion including a first engage portion engaging with the door and a second engage portion engaging with the apparatus body, and a reinforcing member locking the door when the body portion is broken by force applied to the door in opening the door.

Further features of the present invention will become apparent from the following description of exemplary embodiments with reference to the attached drawings.

DESCRIPTION OF THE EMBODIMENTS

Figure 1:
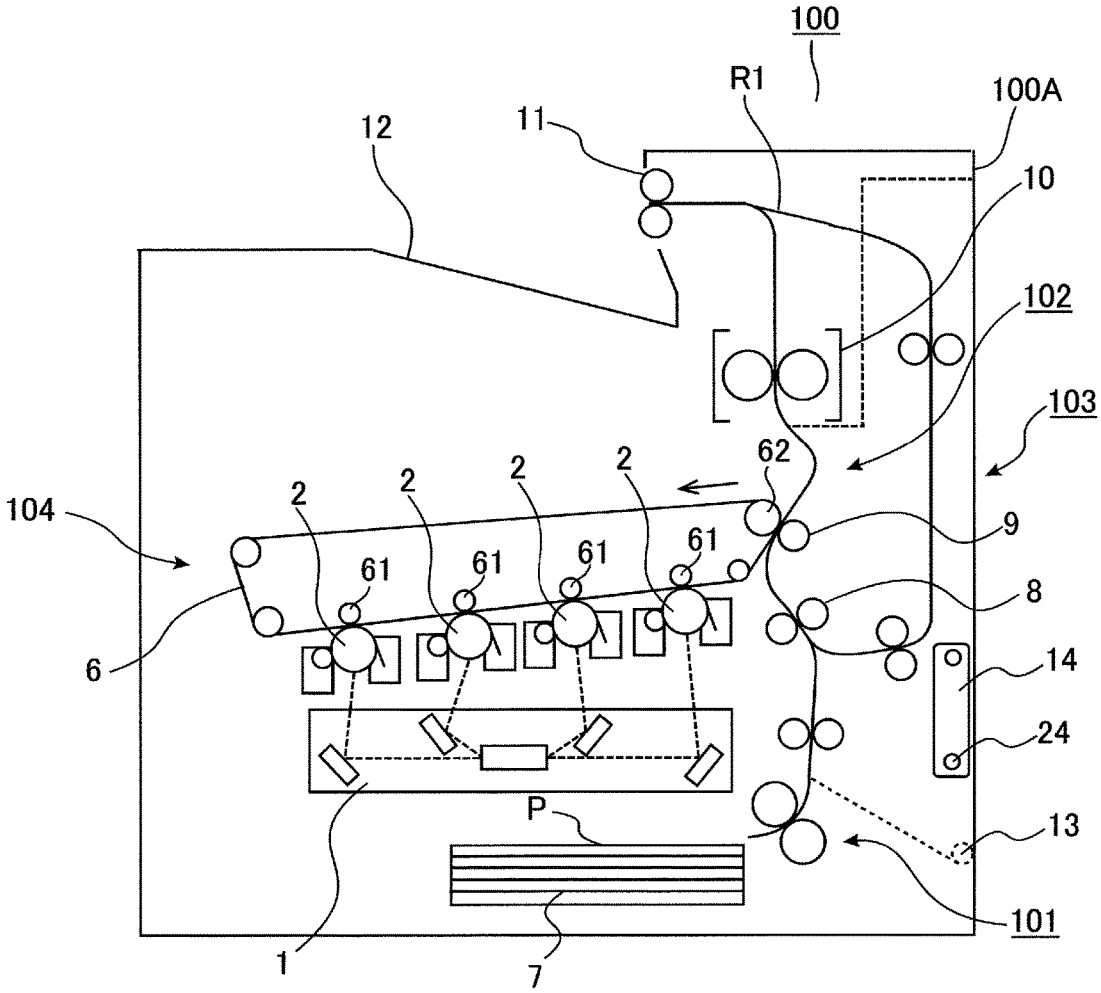
FIG. 1 is a schematic diagram illustrating a configuration of a full-color laser printer, i.e., one exemplary image forming apparatus, according to an embodiment of the invention.

An embodiment of the invention will be described in detail with reference to the drawings. FIG. 1 is a schematic diagram illustrating a configuration of a laser printer, i.e., one exemplary image forming apparatus according to the embodiment of the invention. The laser printer 100 (referred to simply as a 'printer' hereinafter) includes a printer body 100A. The printer body 100A includes an image forming portion 102 forming an image on a sheet P, a sheet feeding portion 101 feeding the sheet P from a sheet feed cassette 7, and others.

The image forming portion 102 includes a scanner unit 1, photosensitive drums 2, and an intermediate transfer unit 104 including an intermediate transfer belt 6. Here, the intermediate transfer belt 6 is disposed so as to be in contact with the respective photosensitive drums 2 and rotates in a direction of an arrow in FIG. 1 by being driven by a driving roller 62 driven by a driving portion not shown. Primary transfer rollers 61 being in contact with the intermediate transfer belt 6 are disposed on an inside surface of the intermediate transfer belt 6.

It is noted that a secondary transfer roller 9 composing a secondary transfer portion transferring a full-color image formed on the intermediate transfer belt 6 onto the sheet P is provided at a position facing the driving roller 62 of the intermediate transfer unit 104. Still further, a fixing portion 10 is disposed above the secondary transfer roller 9, and a discharge roller pair 11 is disposed downstream in a sheet conveying direction of the fixing portion 10.

Next, an image forming operation of the laser printer 100 constructed as described above will be described. In response to a start of the image forming operation, the scanner unit 1 irradiates a laser beam based on image information inputted from a personal computer or the like (not shown) to expose a surface of the photosensitive drum 2 homogeneously charged with predetermined polarity and potential, and to form an electrostatic latent image on the photosensitive drum 2. After that, the electrostatic latent image is developed and visualized by toner. Then, toner images of four colors of yellow (Y), magenta (M), cyan (C), and black (Bk) are transferred onto the intermediate transfer belt 6 by a transfer bias applied to the primary transfer rollers 61 to form a full-color toner image on the intermediate transfer belt 6.

Concurrently with the image forming operation, the sheet P stored in the sheet feed cassette 7 is delivered out by the sheet feeding portion 101. The sheet P is then conveyed to an inactivated registration roller pair 8 to correct a skew thereof. Next, the registration roller pair 8 is driven to convey the sheet P so as to align a front end of the sheet P whose skew has been corrected with a position of the full-color toner image on the intermediate transfer belt 6 in the secondary transfer portion. Then, the full-color toner image is collectively transferred onto the sheet P by a secondary transfer bias applied to the secondary transfer roller 9 in the secondary transfer portion.

Next, the sheet P onto which the full-color toner image has been transferred is conveyed to the fixing portion 10 to fix the toner image on the sheet P as a full-color image by melting and blending the toners of the respective colors by heat and pressure. The sheet P on which the full-color image has been fixed is discharged by the discharge roller pair 11 to a discharge tray 12 provided on an upper surface of the printer body. It is noted that in a case when images are to be formed on both surfaces of the sheet P, the discharge roller pair 11 is reversely rotated to convey the sheet P on which the toner image has been fixed to a duplex path R1 and again to the image forming portion 102.

By the way, as shown in FIG. 1, the printer body 100A is provided with a door 103 supported turnably (openably) in a vertical direction at one side surface of the apparatus by a turning shaft 13 provided at a lower end thereof as a fulcrum. The door 103 can be opened to remove a jammed sheet jammed at the registration roller pair 8, for example, or to conduct maintenance of the apparatus.

Figure 2:
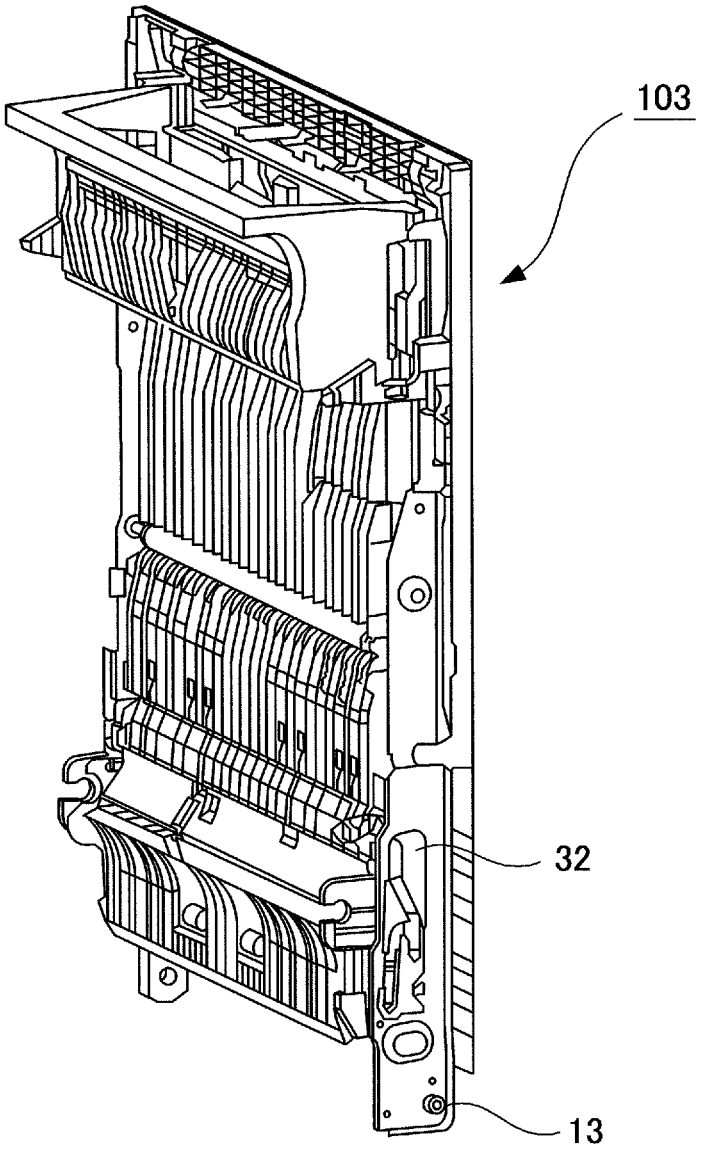
FIG. 2 is a perspective view of a door of a laser printer.
Figure 3:
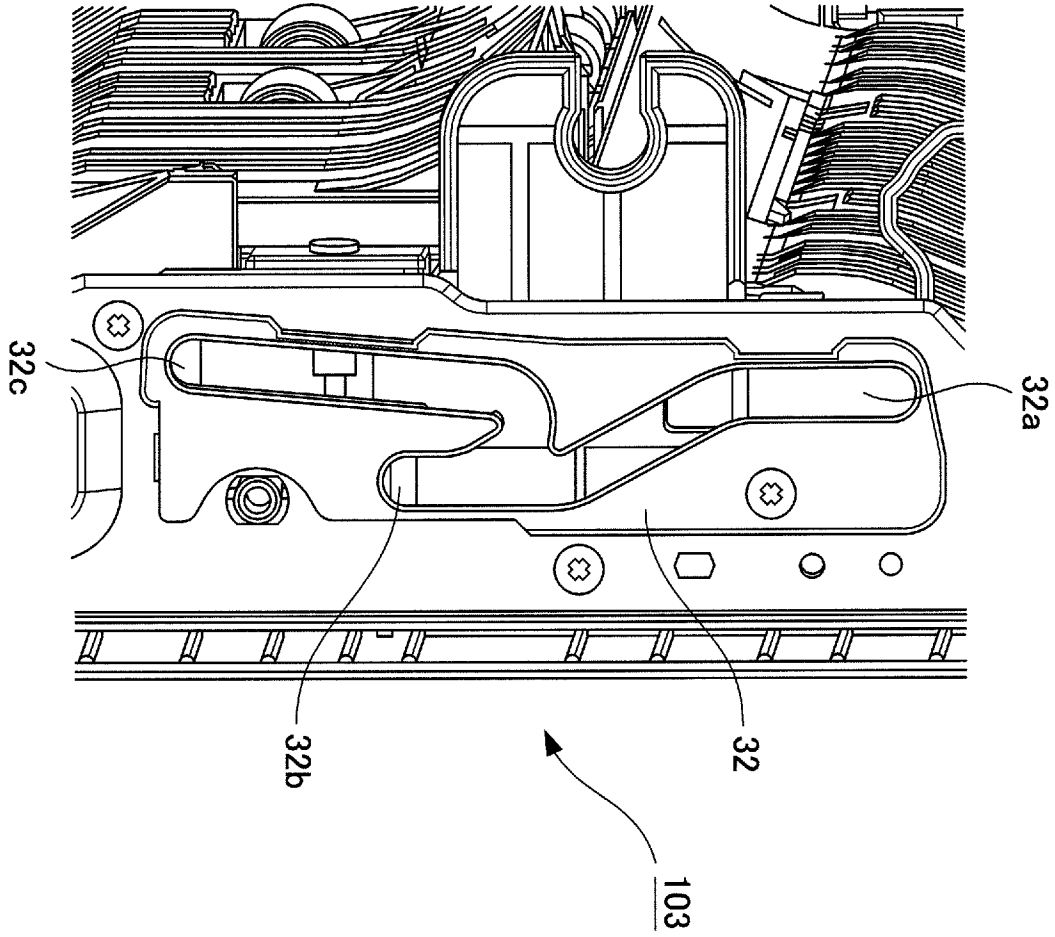
FIG. 3 illustrates a rail member provided on the door.

An opening angle of the door 103 is restricted with respect to the printer body 100A by a stopper member 14, provided on a front side of the printer body 100A and turning and centering on a turning shaft portion 24 as a fulcrum, and a stopper member (not shown) (rear-side stopper member), provided inside of the front-side stopper member 14, so as to face the front-side stopper member 14 (collectively, stopper members 14). A rail member 32 is provided as shown in FIG. 2 in order to restrict the opening angle of each stopper member 14, as described above. As shown in FIG. 3, the rail member 32 includes a first path 32*a*, a second path 32*b*, and a third path 32*c* branched from a part between the first and second paths 32*a* and 32*b*.

Figure 4:
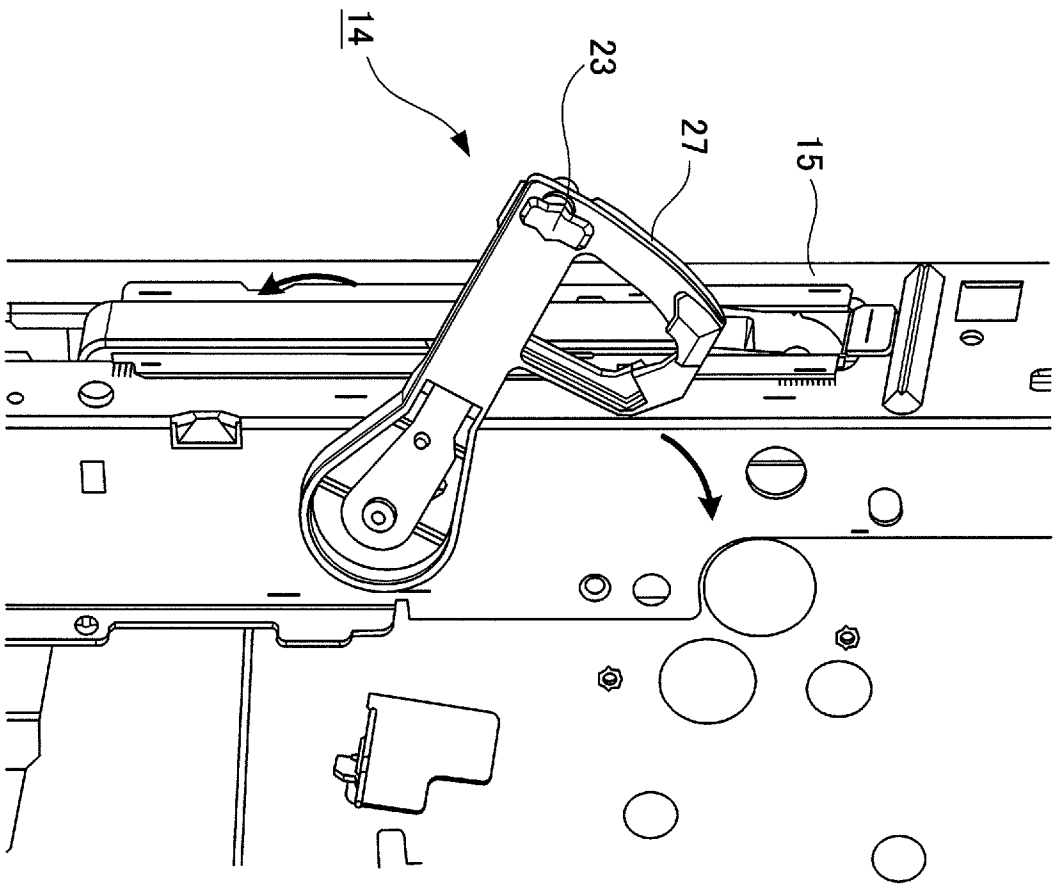
FIG. 4 illustrates a stopper member provided on a printer body of the laser printer.

Here, the first, second, and third paths 32*a*, 32*b*, and 32*c*, respectively, are paths where a project portion 23, i.e., a first engage portion, provided at a turning end of a stopper member 14 shown in FIG. 4. It is noted that the stopper member 14, i.e., an arm portion, is turnably supported by a body frame 15 which centers on a turning shaft portion 24, i.e., a second engage portion, shown in FIG. 1 as a fulcrum, and includes a grip portion 27 manipulated when the project portion 23 enters into the third path 32*c*, as described later.

Then, when the door 103 is opened, the project portion 23 of the stopper member 14 moves slidingly through the slit-like first path 32*a* to the second path 32*b* of the rail member 32, such that the rail member 32 slidably supports the project portion 23 and holds the door 103 in an open condition by locking the project portion 23. Here, while the door 103 is opened to remove a jammed sheet, normally the project portion 23 moves from the first path 32*a* to the second path 32*b* by the weight of the stopper member 14 when the door 103 is opened to remove the jammed sheet.

Then, the door 103 is held at an opening angle (first open position), for handling removal of the jammed sheet, by the stopper member 14, the project portion 23 of the stopper member 14 having moved to the second path 32*b*. That is, the second path 32*b* keeps the door 103 at the first opening angle to handle removal of the jammed sheet by means of the stopper member 14. Still further, the project portion 23 enters the first path 32*a* so that the stopper member 14 does not obstruct the door 103 from being closed.

The door 103 is also opened for purposes of maintaining and inspecting the apparatus. In this case, the door 103 is opened at first to the first opening angle, and then an operator places a finger on the grip portion 27 of the stopper member 14 to guide the project portion 23, which has been moved to the second path 32*b*, to the third path 32*c*. Thereby, the door 103 is opened further to a second opening angle (second open position) for maintenance by the stopper member 14, the project portion 23 of the stopper member having moved to the third path 32*c*. It is noted that the second opening angle for maintenance is larger than the first opening angle for handling removal of the jammed sheet.

Figure 5A:
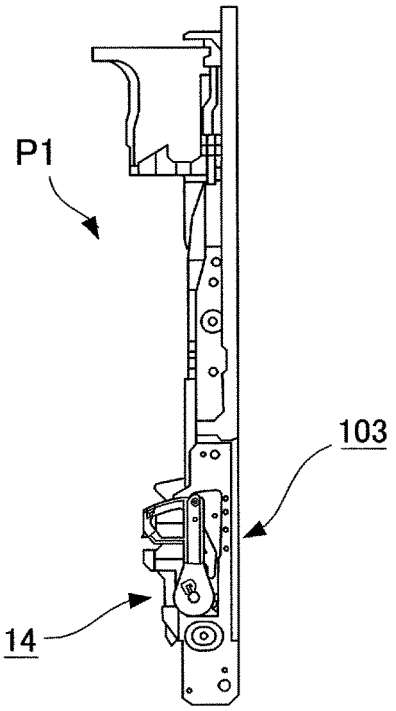
FIG. 5A illustrates a state in which the door is closed.
Figure 5B:
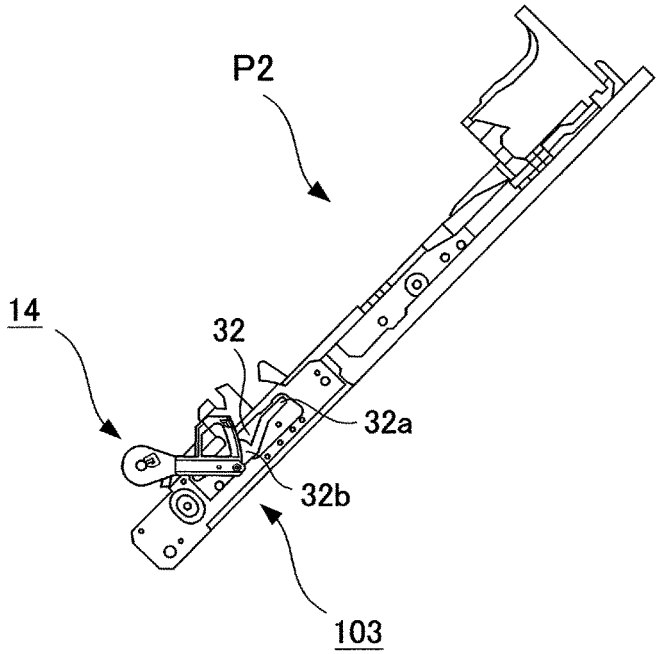
FIG. 5B illustrates a state when the door is opened when jamming has occurred.
Figure 5C:
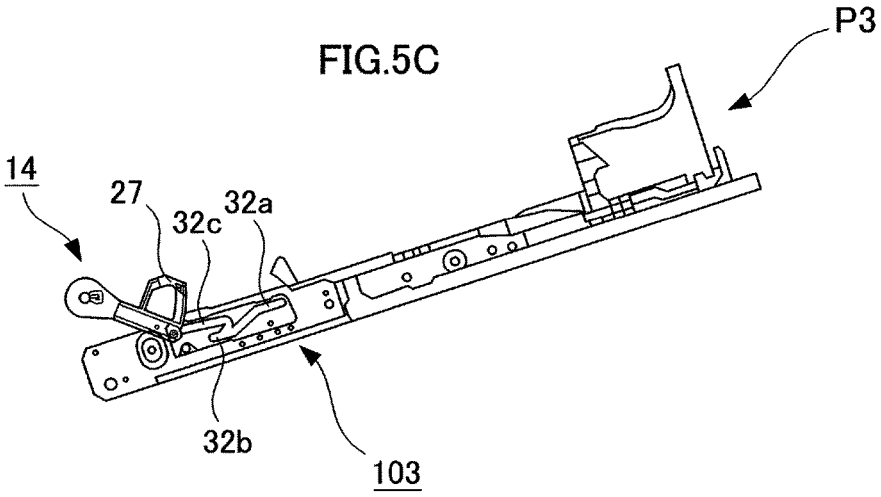
FIG. 5C illustrates a state when the door is opened for maintenance.

FIGS. 5A through 5C illustrate conditions of the stopper member 14 in opening/closing the door 103. FIG. 5A illustrates a condition when the door 103 is closed (condition P1). At this time, the project portion 23 of the stopper member 14 is located within the first path 32*a*. FIG. 5B illustrates a condition when the door 103 is opened when jamming has occurred (condition P2). At this time, the project portion 23 of the stopper member 14 is in contact with an inner wall face of one end of the second path 32*b*. The door 103 is held at the first opening angle for handling removal of the jammed sheet in this condition.

FIG. 5C indicates a condition when the door 103 is opened (condition P3) to attach/detach a unit, a component, or the like within the image forming apparatus or to maintain the apparatus such as cleaning of an inside of the printer body. At this time, the project portion 23 of the stopper member 14 is in contact with an inner wall face of one end of the third path 32*c* as a result of the manipulation of the grip portion 27. The door 103 is held at the second opening angle in this condition. Thus, it is possible to switch the opening angle (open position) of the door 103 by switching the positions where the project portion 23 of the stopper member 14 is locked in the rail member 32.

By the way, while an operation of opening the door 103 is conducted after releasing a lock mechanism (not shown), there is a case when the operator removes his/her hand during this operation, or applies a force in a direction in which the door 103 is opened in moving the condition from the condition P1 shown in FIG. 5A to the condition P2 shown in FIG. 5B. Here, because the door 103 turns centering on the turning shaft 13 provided at the lower end as the fulcrum, the door 103 turns until it reaches a position corresponding to the condition P2, shown in FIG. 5B, by its own weight.

Still further, the stopper member 14 is mounted turnably centering on the turning shaft portion 24 as the fulcrum, as shown in FIG. 1 and as described above. Therefore, the project portion 23 of the stopper member 14 enters from the first path 32*a* to the second path 32*b* along with the turn of the door 103, and then collides against the inner wall face of one end of the second path 32*b*. When the project portion 23 collides against the end of the second path 32*b* as described above, a large impact force is applied to the stopper member 14 and the body frame 15 and others supporting the stopper member 14, so that the stopper member 14 or components of the body frame 15 and others are possibly deformed or broken.

Figure 6:
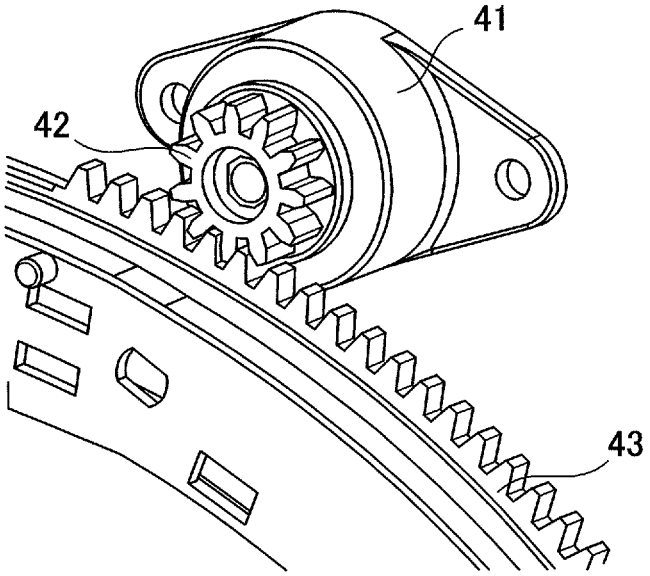
FIG. 6 illustrates a rotary damper provided in the laser printer.

Therefore, according to the present embodiment, the printer body 100A is provided with a damper mechanism as shown in FIG. 6 in order to relieve such impact force. That is, FIG. 6 shows a rotary damper 41 is provided on a frame (not shown) of the printer body 100A. The rotary damper 41 includes a rack 43, provided on the door 103, and a pinion 42 engaging with the rack 43. The pinion 42 and the rack 43 relieve the impact force by retarding a turning speed of the door 103 by engaging with each other and applying a load in a turning direction of the door 103.

By the way, in setting a torque value of the rotary damper 41 relieving the impact force, it is necessary to increase the torque value of the rotary damper 41 to avoid deformation and breakage of the related components if an assumed value of the impact force is large. However, if the torque value of the rotary damper 41 is large, a rotary load generated by the rotary damper 41 becomes resistant to an operating force for opening/closing the door 103 and reduces the operability. Still further, because there is a case when the door 103 stops moving between the conditions P1 and P2, as described above and as shown in FIGS. 5A through 5C, if the operator removes his/her hands from the door when opening the door 103, the operator is required to add an extra force in the opening direction of the door 103.

In contrast, if the assumed value of the impact force is set to be too small, there is a case when the stopper member 14 itself and the components, such as the body frame 15, are deformed or are broken. Then, assuming that a total weight of the door 103 is about 4 kg, and the opening angle when the door 103 is in the condition P2 is 45°, an arrangement in which about 80 N is applied to the stopper members 14 (about 40 N on each stopper member) located on the front and rear sides of the printer body 100A when the door 103 stands still in the condition P2 is adopted in the present embodiment.

It is noted that in a case when the lock is released in a state in which there is no damper mechanism and the door 103 is capable of freely falling in the opening direction, a force applied to the stopper members 14 is about 200 N (100 N on each stopper member). Under such a condition, a maximum value of the impact force applied to the stopper members 14 when the user vigorously opens the door 103 is assumed to be 1000 N, which is five times of the impact force of the force of free fall in the present embodiment.

In light of the condition described above, each stopper member 14 is constructed by a material having such strength by which the front- and rear-side stopper members 14 are not broken even if the impact force of 1000 N (500 N on each stopper) in total is applied to the stopper members 14. Actually, a material having strength that sustains the impact force of about 600 N on each stopper is adopted for the stopper members 14.

Still further, the rotary damper 41 used is configured such that a resistance load of 50 to 70 N is applied to the opening operation of the door 103 by the damping function in a range from a middle of the moving path of the conditions P1 to P2, to the position of the condition P2. The use of such a rotary damper 41 makes it possible to minimize the deformation or the like of the peripheral components, and to steadily put the door 103 into the condition P2 without stopping movement of the door 103 which is freely falling.

However, even if the stopper member 14 and the rotary damper 41 constructed as described above are used, there is a case when the stopper member 14 deforms or breaks if an impact force of more than estimation is applied to the stopper member 14 through the door 103 during opening of the door 103. Then, although it may be possible to prevent the stopper member 14 from being broken if the stopper member 14 is made of a material of higher strength, there is a case when the body frame 15, to which the stopper member 14 is mounted, or part of the door 103 is broken.

Then, the stopper member 14 is configured so as to prevent the entire stopper member 14, the door 103, and others from being broken when the stopper member 14 is pulled by an impact force of more than estimation applied through the door 103, by providing a configuration in which just a part of the stopper member 14 is broken in the present embodiment.

Figure 7A:
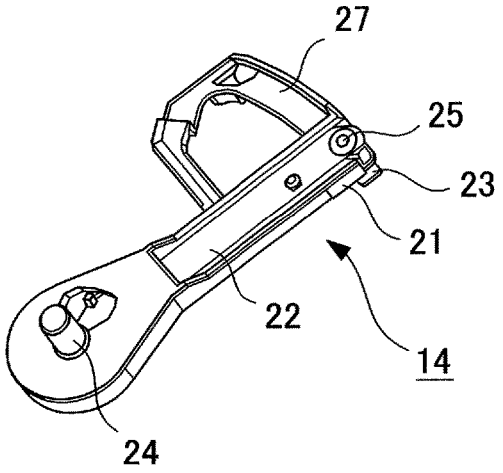
FIG. 7A is a perspective view illustrating a configuration of the stopper member.
Figure 7B:
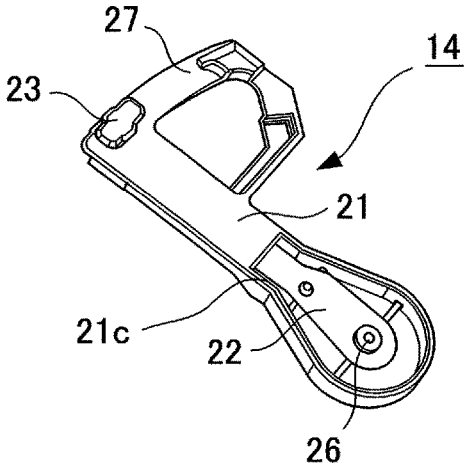
FIG. 7B is a perspective view of the stopper member viewed from a direction different from a direction of FIG. 7A.

FIGS. 7A and 7B are perspective views illustrating the configuration of the stopper member 14 of the present embodiment. FIG. 7A is a perspective view of the stopper member 14 and FIG. 7B is a perspective view of the stopper member 14 viewed from a different direction from that of FIG. 7A.

In FIGS. 7A and 7B, the stopper member 14 includes a base member 21 made of a resin material composing a body portion of the stopper member 14, a turning shaft portion 24 formed at one end part of the base member 21, the project portion 23 formed on another side of the base member 21, a reinforcing member 22 made of a metallic material and attached to the base member 21 so as to reinforce the base member 21, and first and second screws 25 and 26, i.e., shaft-like members, joining the base member 21 with the reinforcing member 22.

Figure 8:
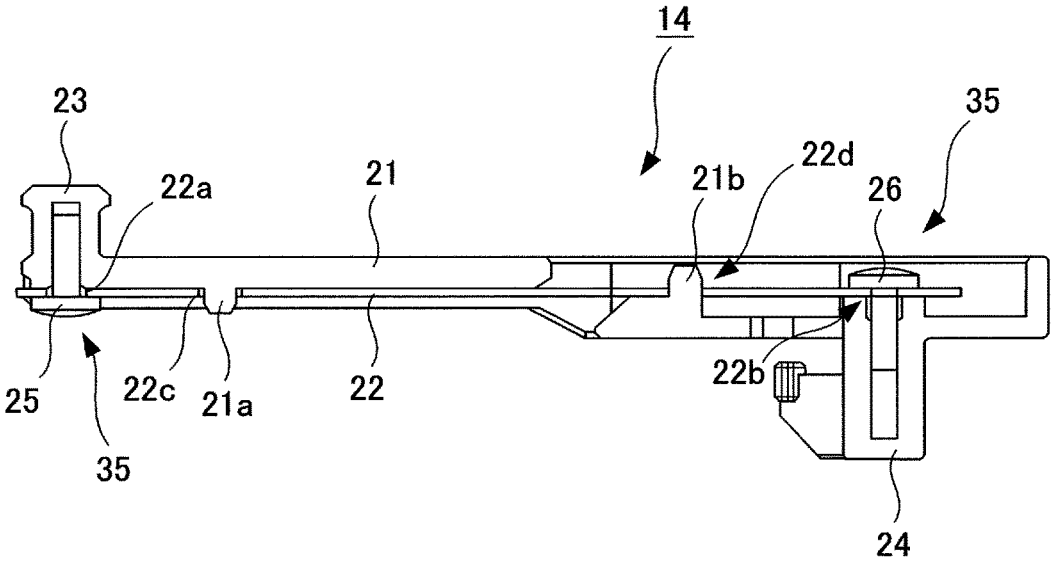
FIG. 8 is a section view illustrating the configuration of the stopper member.

It is noted that positions where the base member 21 is joined with the reinforcing member 22 by the first and second screws 25 and 26 are set such that the first screw 25 enters the project portion 23 and the second screw 26 enters the turning shaft portion 24 in the present embodiment, as shown in FIG. 8. It is then possible to enhance the strength of the project portion 23 and the turning shaft portion 24, and sustain same from breakage, by joining the base member 21 with the reinforcing member 22 by inserting the first screw 25 into the project portion 23 and the second screw 26 into the turning shaft portion 24. That is, the project portion 23 is reinforced by the first screw 25, and the turning shaft portion 24 is reinforced by the second screw 26, respectively.

Still further, as shown in FIG. 8, the reinforcing member 22 is provided with a first insertion hole 22*a* through which the first screw 25, i.e., the first shaft-like member, enters the project portion 23, and a second insertion hole 22*b* through which the second screw 26, i.e., the second shaft-like member, enters the turning shaft portion 24. Thus, a joining mechanism 35 joining the reinforcing member 22 with the base member 21 is composed of the first screw 25 and the first insertion hole 22*a* and the second screw 26 and the second insertion hole 22*b*.

It is noted that the reinforcing member 22 is also provided with a third insertion hole 22*c* as shown in FIG. 8. A convex portion 21*a* formed on the base member 21 is locked by the third insertion hole 22*c* with a gap similar to a gap S shown in FIG. 9B and described later. The reinforcing member 22 is also provided with a fourth insertion hole 22*d* through which a convex portion 21*b* formed on the base member 21 is locked without forming any gap.

Figure 9A:
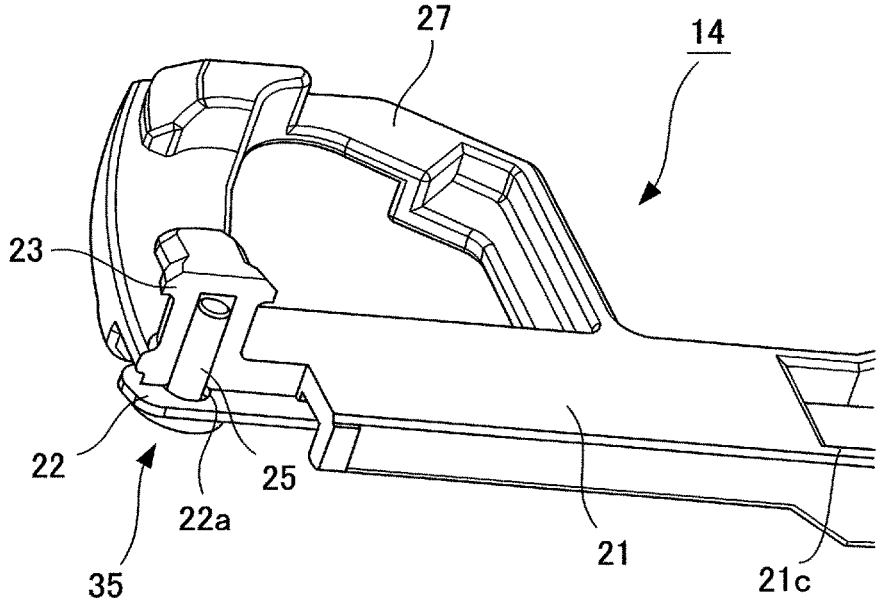
FIG. 9A is a partial section view illustrating a joining portion joining a base member with a reinforcing member of the stopper member by a screw.
Figure 9B:
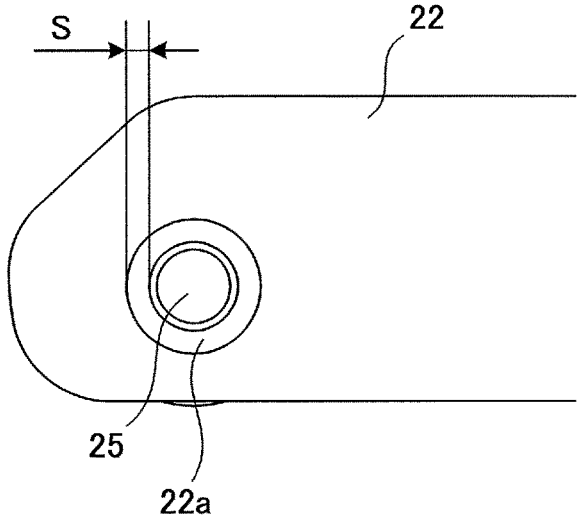
FIG. 9B illustrates a relationship between the reinforcing member and the screw in a state in which the base member is not deformed.

Here, a diameter of the first insertion hole 22*a* through which the first screw 25 enters the project portion 23 as shown in FIG. 9A is a diameter forming the gap S in a radial direction as shown in FIG. 9B in a state in which the first screw 25 enters the first insertion hole 22*a*.

It is noted that this gap S is set at a maximum range or more in which the base member 21 can extend by a tensile force applied to the base member 21 by impact in the present embodiment. Still further, a diameter of the second insertion hole 22*b* through which the second screw 26 enters the turning shaft portion 24 is a diameter forming no gap in a state in which the second screw 26 enters the second insertion hole 22*b*.

Figure 10:
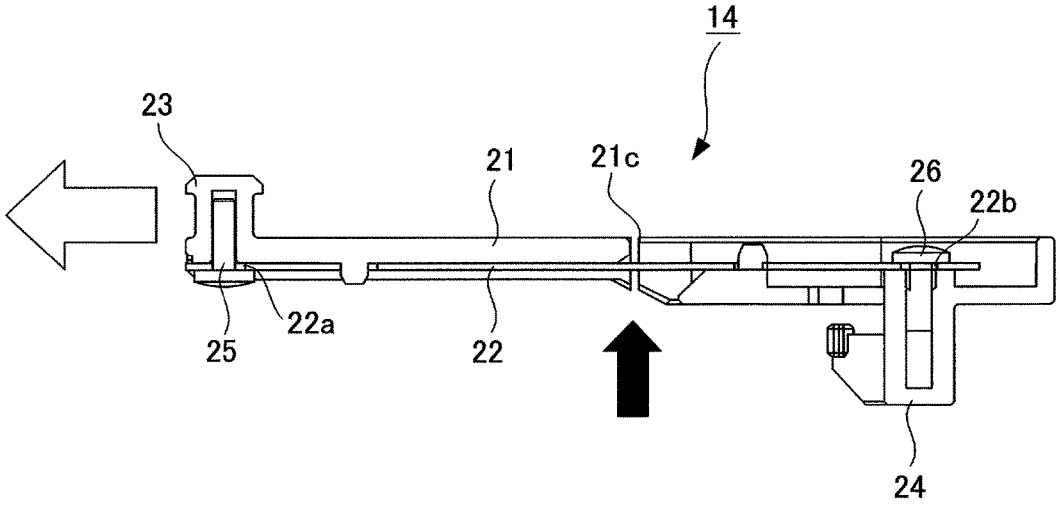
FIG. 10 illustrates a state in which the base member of the stopper member is broken.

There is a case when an impact force of more than estimation, i.e., a force larger than the tensile strength of the base member 21, is applied to the stopper member 14, constructed as described above, in a direction of a white arrow (in a longitudinal direction of the arm portion), as shown in FIG. 10, when a force more than a predetermined magnitude is applied to the door 103 in opening the door 103. In this case, the impact force is applied to the project portion 23 and the turning shaft portion 24 of the stopper member 14, and the tensile force acts on the second screw 26 inserted in the turning shaft portion 24 and the first screw 25 inserted in the project portion 23.

At this time, the second screw 26 inserted in the turning shaft portion 24 does not move, because no gap is provided between the second screw 26 and the second insertion hole 22*b*. However, the first screw 25 inserted in the project portion 23 is capable of moving along the first insertion hole 22*a*, because the gap S is provided between the first screw 25 and the first insertion hole 22*a*. Therefore, when such force is applied to the project portion 23, the base member 21 elastically deforms while moving the first screw 25 along the first insertion hole 22*a*.

However, because the gap S is set at the maximum range in which the base member 21 can extend by the elastic deformation, or at a breakdown distance longer than that as described above, the elastically deformed base member 21 breaks (fractures) at a position indicated by a black arrow in FIG. 10. It is noted that the base member is provided with a fracture portion 21*c* formed such that strength thereof is lower than that of other parts of the base member 21 at the position indicated by the black arrow where stress concentration is generated between the project portion (first engage portion) 23 and the rotary shaft portion (second engage portion) 24. The fracture portion 21*c* is formed to break down first when a stress of more than a predetermined magnitude is generated in the base member 21. The fracture portion 21*c* is constructed by providing an opening in a groove portion of the base member 21 holding the reinforcing member 22 in the present embodiment. It is noted that the fracture portion 21*c* may be constructed by providing, other than the opening (hole), a crack, a groove, a step, or the like on the base member 21. It is then possible to absorb the impact force by thus breaking the base member 21. That is, the base member 21 is joined with the reinforcing member 22 such that the base member 21 is pulled and is broken in the case when a force of a predetermined magnitude is applied to the door 103 in opening the door 103.

Figure 11A:
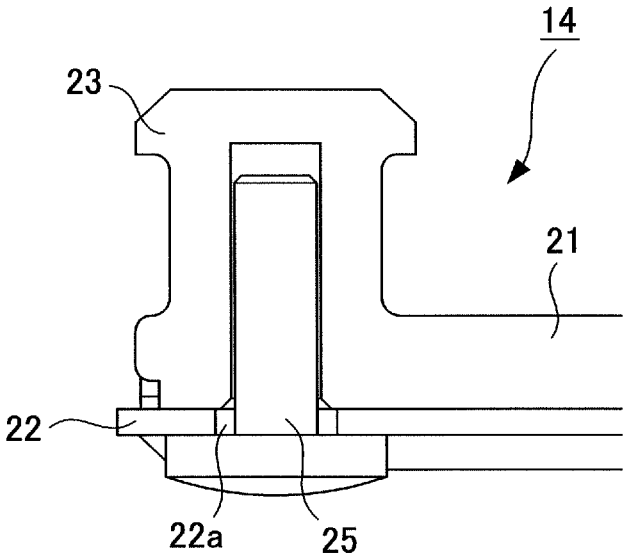
FIG. 11A illustrates the relationship between the screw and the reinforcing member before the base member of the stopper member is broken.
Figure 11B:
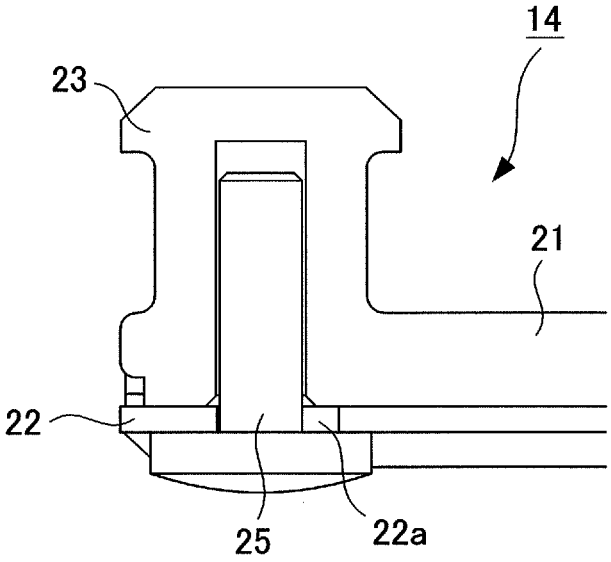
FIG. 11B illustrates the relationship between the screw and the reinforcing member after the base member of the stopper member is broken.

It is noted that if the base member 21 is broken, the base member 21 moves in a body with the first screw 25 from a position shown in FIG. 11A to a position where the first screw 25 engages with one inner wall face of the first insertion hole 22*a* of the reinforcing member 22, as shown in FIG. 11B. Then, after that, the first screw 25 engages with the first insertion hole 22*a* of the reinforcing member 22, and thereby, the project portion 23 is limited from moving by the reinforcing member 22. As a result, it is possible to prevent the project portion 23 from disengaging from the door 103 and to prevent the door 103 from falling down to a floor.

As described above, the gap S is provided between the first insertion hole 22*a* and the first screw 25, and in the case when an impact force of more than estimation is applied, the base member 21 is configured to be broken, and the door 103 is held by the reinforcing member 22 in the present embodiment. This arrangement makes it possible to prevent the entire stopper member 14 from being broken and to prevent the door 103 from falling down. That is, in the case when the force of more than the predetermined magnitude is applied to the door 103 in opening the door 103, it is possible to prevent the door and the body of the image forming apparatus from being broken in opening the door without lowering the operability by joining the reinforcing member with the body portion of the stopper member 14 such that the body portion is pulled and is broken. It is noted that in the case when the base member 21 is broken, it is possible to handle such case only by replacing the stopper member 14 and to avoid such a situation that the door 103 and the body frame 15, i.e., large size units, are deformed or replaced.

That is, the base member 21 is joined with the reinforcing member 22 such that the base member 21 is broken and the door 103 is held by the reinforcing member 22 when the force of more than the predetermined magnitude is applied to the project portion 23 in opening the door 103 in the present embodiment. This arrangement makes it possible to prevent the entire stopper member 14, the door 103, and the printer body 100A from being broken when opening the door 103, without lowering the operability.

Figure 12A:
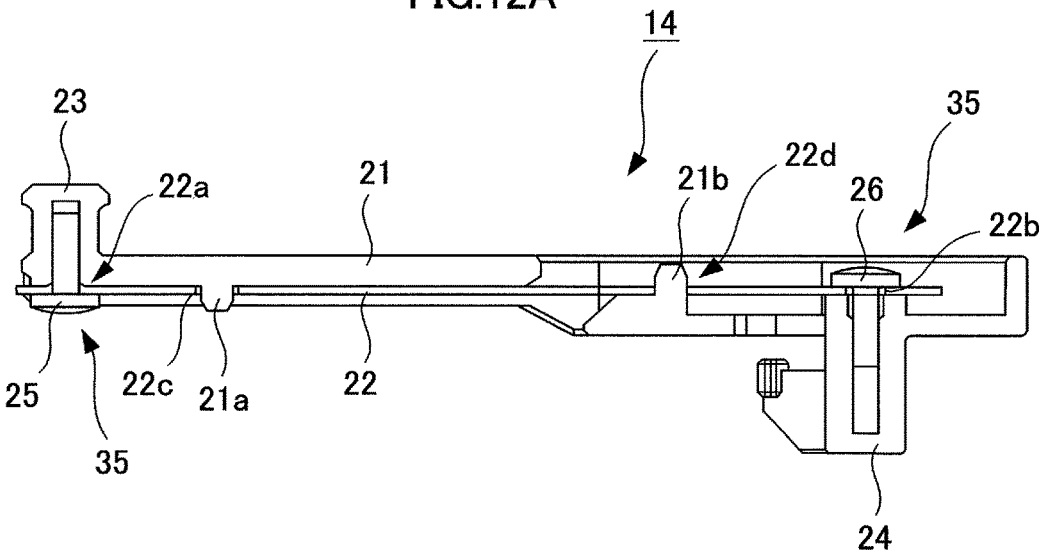
FIG. 12A illustrates another configuration of the stopper member in which a gap is provided between a second insertion hole and a second screw.
Figure 12B:
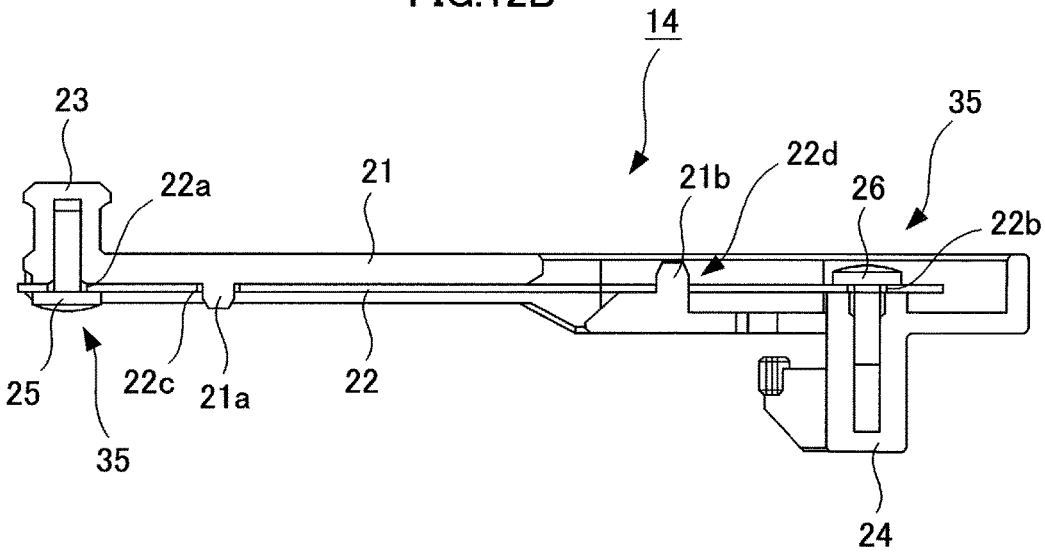
FIG. 12B illustrates another configuration of the stopper member in which a gap is provided between a first insertion hole and a first screw and between the second insertion hole and the second screw.

It is noted that while the gap S is provided between the first insertion hole 22*a* and the first screw 25, as described above, it is also possible to provide a gap between the second insertion hole 22*b* and the second screw 26 as shown in FIG. 12A. Still further, the gap may be provided between the first insertion hole 22*a* and the first screw 25, as well as between the second insertion hole 22*b* and the second screw 26. That is, the same operation may be obtained by providing the gap S either between the first insertion hole 22*a* and the first screw 25, or between the second insertion hole 22*b* and the second screw 26.

Still further, while the base member 21 of the stopper member 14 has been a resin-made member and the reinforcing member 22 has been a metallic member in the embodiment described above, the materials of those components are not specifically limited. For instance, the base member 21 may be a rubber material, and the reinforcing member 22 may be a resin material. However, if a material such as metal, having a high strength, is used for the base member 21, it is preferable to provide a part that is partially constricted, for example, such that the part breaks if an impact force of more than estimation is applied. It is also possible to provide a configuration such that the base member 21 is composed of a plurality of members, and the members are broken in order corresponding to an impact force.

Still further, although the screws are used as the shaft-like members joining the base member 21 with the reinforcing member 22 in the present embodiment, the present invention is not specifically limited to such configuration. For instance, it is possible to obtain the same effect by providing a configuration in which a metallic pin inserted or hooked into a hole provided through the reinforcing member 22 is secured by means of press fitting. Still further, while the door 103 has the two open positions in the embodiment described above, a number of open positions may be provided, such as one, or three or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-203685, filed Oct. 2, 2014, which is hereby incorporated by reference herein in its entirety.

What is claimed is:

1. An image forming apparatus, comprising:

an apparatus body;

a door openably supported by the apparatus body;

a first member configured to restrict an opening angle of the door, the first member comprising a first engage portion engaging with the door, and a second engage portion engaging with the apparatus body; and a second member configured to restrict the opening angle of the door if the first member is broken such that the first and second engage portions are separated.

2. The image forming apparatus according to claim 1, wherein the second member is configured to join the first and second engage portions if the first member is broken.

3. The image forming apparatus according to claim 1, further comprising an insertion member configured to join the second member with the first member, the insertion member having a shaft portion, wherein the second member comprises a portion defining an insertion hole, through which the shaft portion of the insertion member is inserted in a condition in which a gap is provided between the portion defining the insertion hole and the shaft portion.

4. The image forming apparatus according to claim 1, further comprising first and second insertion members configured to join the second member with the first member, wherein the second member comprises a first portion defining a first insertion hole provided at one end part of the second member and through which a shaft portion of the first insertion member is inserted, and a second portion defining a second insertion hole provided at another end part of the second member and through which a shaft portion of the second insertion member is inserted, wherein the shaft portions of the first and second insertion members are inserted into the first and second insertion holes, respectively, in a condition in which a gap is provided between at least one of:

(i) the first portion defining the first insertion hole and the shaft portion of the first insertion member, and (ii) the second portion defining the second insertion hole and the shaft portion of the second insertion member.

5. The image forming apparatus according to claim 4, wherein the first insertion member joins the second member with the first member by entering an inside of the first engage portion, and the second insertion member joins the second member with the first member by entering an inside of the second engage portion.

6. The image forming apparatus according to claim 1, wherein the first member is a resin-made member and the second member is a metallic member.

7. The image forming apparatus according to claim 1, wherein the first engage portion is a projection slidably supported by the door, and the second engage portion is a shaft portion turnably supported by the apparatus body.

8. The image forming apparatus according to claim 1, wherein the second member is formed separately from the first member.

9. An image forming apparatus, comprising:

an apparatus body;

a door openably supported by the apparatus body;

a stopper member comprising a first engage portion engaging with the door, and a second engage portion engaging with the apparatus body, the stopper member being configured to hold the door in an open condition;

a metal member comprising at least a first portion defining a first hole;

a first insertion member comprising a first shaft portion inserted through the metal member and provided in the door; and a second insertion member comprising a second shaft portion inserted through the metal member and provided in the apparatus body, wherein at least one of the first and second insertion members is inserted through the first hole defined by the first portion of the metal member, a gap being provided between the first portion defining the first hole of the metal member and at least one of the first and second shaft portions in a state in which the stopper member holds the door in the open condition.

10. The image forming apparatus according to claim 9, wherein the metal member further comprises a second portion defining a second hole, wherein the first shaft portion of the first insertion member is inserted in the first hole, and the second shaft portion is inserted in the second hole, and wherein the gap is provided between at least one of:

(i) the portion defining the first hole and the first shaft portion of the first insertion member, and (ii) the portion defining the second hole and the second shaft portion of the second insertion member, in the state in which the stopper member holds the door in the open condition.

11. The image forming apparatus according to claim 10, wherein the gap between the portion defining the first hole and the first shaft portion of the first insertion member and the gap between the portion defining the second hole and the second shaft portion of the second insertion member are provided in the state that the stopper member holds the door in the open condition.

12. The image forming apparatus according to claim 9, wherein the first and second engage portions are projections engaging with the apparatus body and the door, respectively.

13. The image forming apparatus according to claim 9, wherein the first insertion member is inserted into the first engage portion of the stopper member, and the second insertion member is inserted into the second engage portion of the stopper member.

14. The image forming apparatus according to claim 9, wherein a size of the hole is set such that the stopper member can be elongated until the stopper member is broken in a condition in which the first and second engage portions are separated.

15. The image forming apparatus according to claim 9, wherein the stopper member is a resin-made member.

16. The image forming apparatus according to claim 9, wherein the first insertion member is provided in the door through the first engage portion of the stopper member, and the second insertion member is provided in the apparatus body through the second engage portion of the stopper member.

17. The image forming apparatus according to claim 16, wherein the first insertion member is slidably supported by the door through the first engage portion of the stopper member.

18. The image forming apparatus according to claim 9, wherein the first engage portion is a projection slidably supported by the door, and a part of the first shaft portion of the first insertion member is inserted into the first engage portion of the stopper member.

19. The image forming apparatus according to claim 9, wherein the second engage portion is turnably supported on the apparatus body, and a part of the second shaft portion of the second insertion member is inserted into the second engage portion of the stopper member.

20. An image forming apparatus, comprising:

an apparatus body;

a door openably supported by the apparatus body;

a first member configured to restrict an opening angle of the door, the first member comprising a first engage portion engaging with the door, and a second engage portion engaging with the apparatus body;

a second member; and an insertion member configured to join the second member with the first member, wherein the second member comprises a portion defining an insertion hole through which a shaft portion of the insertion member is inserted in a condition in which a gap is provided between the portion defining the insertion hole and the shaft portion.

* * * * *